US005275405A

United States Patent [19]

Ridge

[11] Patent Number: 5,275,405

[45] Date of Patent: Jan. 4, 1994

[54] FLOOR VENT PUTTING CUP

[75] Inventor: William Ridge, Chatsworth, Ga.

[73] Assignee: Club Pro Products, Inc., Louisville, Ky.

[21] Appl. No.: 837,021

[22] Filed: Feb. 18, 1992

[51] Int. Cl.[5] ..... A63B 69/36

[52] U.S. Cl. ..... 273/178 R; 454/289

[58] Field of Search 273/180, 34R, 34A, 34B, 178R, 178A, 178B; 454/290, 454/289, 291

[56] References Cited

U.S. PATENT DOCUMENTS 2,138,709 11/1938 Rainbolt ..... 454/291
2,704,212 3/1955 Dunseith ..... 273/180
3,391,629 7/1968 Snell ..... 454/290 X
4,275,886 6/1981 Bannon ..... 273/178 R
4,338,859 7/1982 Claytor ..... 454/291
5,120,063 6/1992 Birchler et al. ..... 273/34 A X

*Primary Examiner*—George J. Marlo
*Attorney, Agent, or Firm*—Camoriano & Smith

[57] ABSTRACT

A floor air vent cover includes a centrally located closed bottom depression the size of a putting cup for receiving and retaining a putted golf ball. The opposite ends of the cover contain air passage openings having tapered sides for directing the air flow away from said depression.

5 Claims, 1 Drawing Sheet

FLOOR VENT PUTTING CUP

BACKGROUND F THE INVENTION

We are all familiar with the little putting cups golfers use in order to practice their putting skills in the office or at home, when there is not enough time or the weather is too bad to get out on the golf course. These putting cups simply rest on the floor and include a substantial incline to get the ball up high enough so it can then fall into the cup.

Of course, the substantial incline is not very representative of a typical putting situation on a golf course, in which the ground leading up to the hole is relatively level or slightly inclined. Therefore, the practice the golfer gets putting into a putting cup in the office is probably not very useful as a preparation for putting on the golf course.

Also, the known putting cups are in the way when the golfer is not golfing and have to be stored away when not in use. This requires the golfer to take the time to set them up and put them away for each use or else risk somebody tripping over them.

SUMMARY OF THE INVENTION

The present invention provides a putting cup which has sides that are only slightly inclined, making it much more representative of a real golf course putting situation.

The present invention also eliminates the need for setting up the putting cup for each use and the need for storing the putting cup when it is not in use.

In order to accomplish these advantages, the present invention provides a putting cup which is installed as a floor vent cover, making it a permanent fixture of the building, and making it substantially level with the rest of the floor.

DESCRIPTION OF THE DRAWINGS

Figure 1:
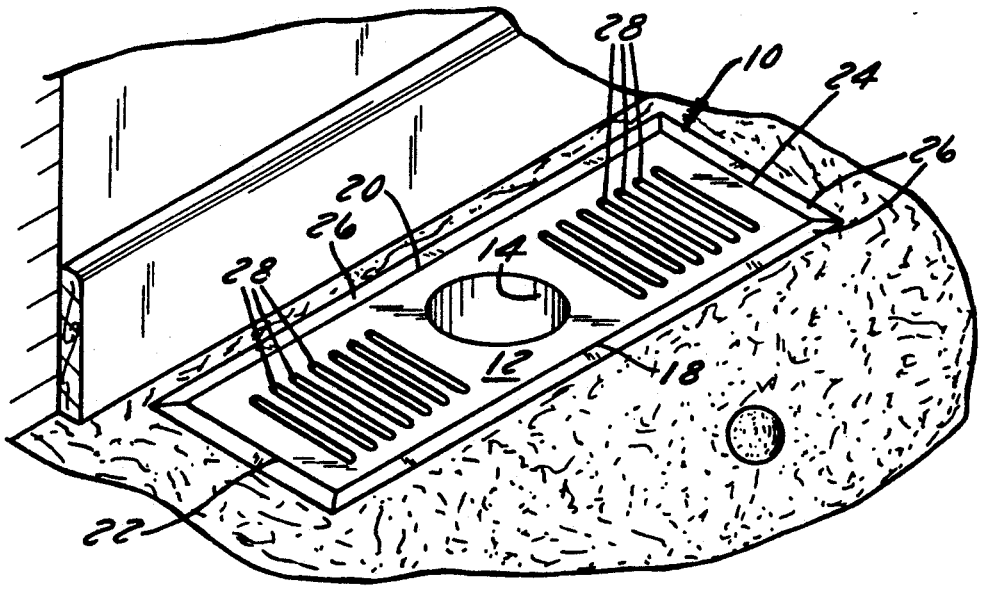
FIG. 1 is a perspective view of the floor vent cover of the present invention, showing the floor vent cover installed over the vent opening.
Figure 2:
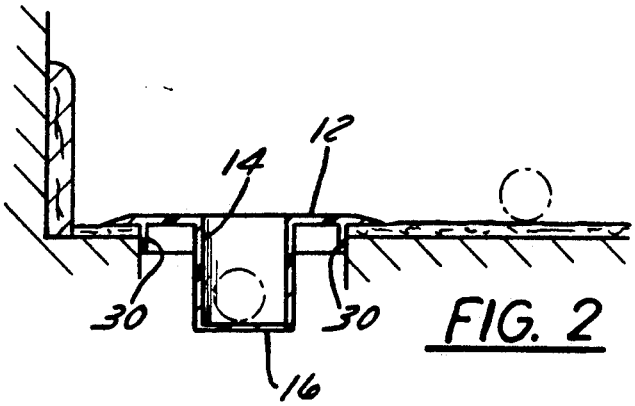
FIG. 2 is a side sectional view of the floor vent cover of FIG. 1, with a golf ball shown in phantom.

The floor vent cover 10 has a substantially flat, rectangular top surface 12, sized to fit over the opening of a floor air vent. In the center of the top surface 12 is a cylindrical depression 14, sized the same size as the hole on a golf course. The cylindrical depression 14 has a closed bottom end 16, to retain the golf ball 18.

Figure 3:
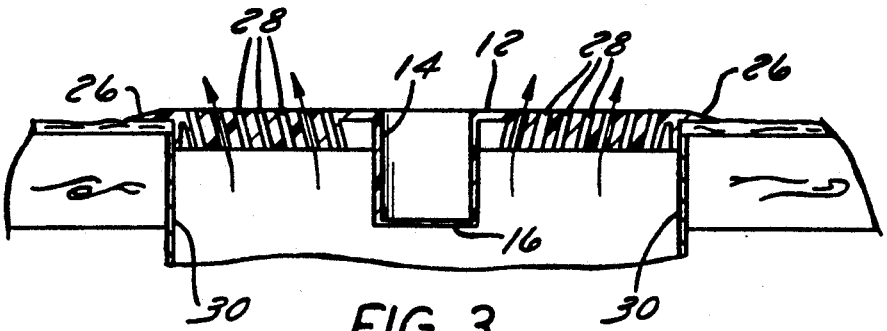
FIG. 3 is an enlarged view of the vent cover of FIG. 2, showing the air flow through the vent cover.

The rectangular top surface 12 has two long sides 18, 20 and two short sides 22, 24. A thin ramp frame 26 extends around the perimeter of the top surface 12, providing a gradual transition from the floor to the top surface 12. The top surface of the ramp 26 is about five degrees from the horizontal in the preferred embodiment, and should be less than fifteen degrees in order to provide a smooth transition from the floor to the vent cover 10. A plurality of elongated openings 28 run parallel to the short sides 22, 24 from the depression 14 to the ends 22, 24, and permit air to flow through the vent cover 10. The sides of the elongated openings 28 extend at an angle in order to direct the air flow away from the central depression 14, as shown in FIG. 3. This prevents the air flow from affecting the movement of the ball toward the cup 14. There are no openings from between the depression 14 and the long sides 18, 20, thereby providing a path free of openings through which the ball may pass. The bottom of the cup 14 may be perforated or solid.

Beneath the top surface 12 project vertical legs 30, which fit inside the vent opening with a snug fit. The vertical legs 30 preferably are connected together to form a rectangular frame, but they could be separate legs.

It will be obvious to those skilled in the art that modifications may be made to the embodiment described above without departing from the scope of the present invention.

What is claimed is:

1. A floor air vent cover, comprising: a substantially flat top surface including a closed bottom depression for receiving and retaining golf bull, said depression being sized substantially the same size as a putting hole on a golf course, said top surface defining a plurality of openings which permit air to flow through the top surface, said openings having tapered sides and being outside the area of said depression so as to leave an uninterrupted path for a golf ball to travel from the outer edge of said vent cover to said depression and to direct the air flow away from said depression.

2. A floor air vent cover as recited in claim 1, and further comprising vertical legs projecting downward from said tops surface, said vertical legs being sized to fit a floor vent opening with a snug fit.

3. A floor air vent cover as recited in claim 1, and further comprising a rim extending outwardly from said top surface, said rim being inclined downward from said top surface at an angle of less than 15 degrees so as to provide a gradual transition onto the vent cover from the floor.

4. A floor vent air vent cover as recited in claim 3, wherein said rim forms a frame around said top surface and defines the outer edge of the vent cover; wherein said depression for receiving a golf ball is located approximately in the center of said top surface; and wherein said openings are located so as to provide an unobstructed path from the outer edge of said vent cover to said depression on at least one side of said vent cover.

5. A floor air vent cover as recited in claim 1 including an outer eye which lies along a straight line.

* * * * *

UNITED STATES PATENT AND TRADEMARK OFFICE

CERTIFICATE OF CORRECTION

PATENT NO. : 5,275,405

DATED : January 4, 1994

INVENTOR(S) : William Ridge

It is certified that error appears in the above-identified patent and that said Letters Patent is hereby corrected as shown below:

Column 2, line 29,"bull" should read --ball--.

Column 2, line 33, --located-- should be inserted after "being".

Column 2, line 58, "eye" should read --edge--.

Signed and Sealed this

Third Day of May, 1994

*Attest:*

*Attesting Officer*

BRUCE LEHMAN

*Commissioner of Patents and Trademarks*